US006227758B1

(12) United States Patent
Missick et al.

(10) Patent No.: US 6,227,758 B1
(45) Date of Patent: May 8, 2001

(54) PROTECTOR FOR THROUGH-THE-CURB DRAIN

(76) Inventors: Gregory J. Missick, 5362 Bolsa Ave., Suite C; Brent W. Chapman, 4771 Pearce St., both of Huntington Beach, CA (US) 92649

( * ) Notice: Subject to any disclaimer, the term of this patent is extended or adjusted under 35 U.S.C. 154(b) by 0 days.

(21) Appl. No.: 09/323,323

(22) Filed: Jun. 1, 1999

Related U.S. Application Data

(63) Continuation-in-part of application No. 09/539,166, filed on Mar. 29, 2000, which is a continuation-in-part of application No. 09/323,323, filed on Jun. 1, 1999.

(51) Int. Cl.[7] ..... E01C 11/22; E03F 5/046

(52) U.S. Cl. ..... 404/4; 404/2; 404/25; 210/164

(58) Field of Search ..... 404/2, 4, 5, 25; 210/164; 403/12

(56) References Cited

U.S. PATENT DOCUMENTS

| | | | | |
|---|---|---|---|---|
| D. 31,239 | | 7/1899 | Fox . | |
| D. 229,185 | | 11/1973 | Bledsoe . | |
| D. 373,181 | | 8/1996 | Howard . | |
| 505,130 | * | 9/1893 | Ryan | 404/2 |
| 1,144,200 | * | 6/1915 | Hewett | 210/164 |
| 1,473,551 | * | 11/1923 | Gschwind | 404/5 |
| 2,263,588 | * | 11/1941 | Odendahl | 210/164 |
| 2,473,279 | | 6/1949 | Crocker . | |
| 2,958,200 | * | 11/1960 | Russell | 210/164 |
| 3,587,239 | * | 6/1971 | Feland | 61/16 |
| 3,788,756 | | 1/1974 | Ito . | |
| 3,881,832 | * | 5/1975 | Maguire | 404/4 |
| 3,957,383 | | 5/1976 | Fredericks . | |
| 4,061,434 | | 12/1977 | Carroll . | |
| 4,192,625 | | 3/1980 | Peletz . | |
| 4,610,566 | * | 9/1986 | Albang et al. | 404/4 |
| 4,637,585 | | 1/1987 | Picollo . | |
| 4,844,403 | | 7/1989 | Castle . | |
| 4,957,268 | | 9/1990 | Picollo et al. . | |
| 4,986,693 | * | 1/1991 | Salberg et al. | 404/4 |

* cited by examiner

*Primary Examiner*—Eileen D. Lillis
*Assistant Examiner*—Raymond W Addie
(74) *Attorney, Agent, or Firm*—James G. O'Neill

(57) ABSTRACT

A protector for a drainpipe exit passing through a sidewalk curb is provided with an angled front face with an exit drain opening formed therein. The angled front face is secured to a top plate, a hollow drainpipe connecting portion, a rear securing element and at least one lower rebar securing element. The curb protector is inserted and held in a form while making or repairing a curb and held therein by concrete poured around a drainpipe connected to the curb protector and the curb protector.

20 Claims, 4 Drawing Sheets

PROTECTOR FOR THROUGH-THE-CURB DRAIN

This application claims the benefit of Document Disclosure No. 424,863, dated October 1997. This application is a CIP 09/539166 filed Mar. 29, 2000, which is a CIP of 09/323323 filed Jun. 1, 1999.

BACKGROUND OF THE INVENTION

1. Field of the Invention

This invention relates generally to curb protectors, and, more particularly, to an improved protector for a through-the-curb roof drain.

2. Description of Related Art For years, contractors have been installing roof drains through curbs by either blocking out the curb, or cutting form lumber and securing a piece of drain pipe in place with wire or some other support method. In some cases, the concrete must be saw-cut to remove the existing curb. Concrete must then be repoured in the removed section, with pipes in place. Additionally, plumbers were often required to be at the job site and prepared to place their pipes in a designated area where concrete was to be poured. If the concrete contractor did not show, or was late, or the curbs were not poured, this resulted in a wasted trip and time for the plumber, thus adding expense to a job. Through practical experience, plumbers have learned that installing roof drain piping though curbs can take up to 45 minutes or longer. However, even after forms are cut and secured in place, it is still possible that the forms will be stepped on or bumped out of alignment. In some sever cases, if the pipes are too far out of alignment, the curb is easily chipped, to the point that it will require replacing. Furthermore, if colored concrete is used, this seemingly minor task becomes very difficult.

The present invention is designed to provide an easy-to-install pipe connection. Once any forms used have been removed, a drainpipe is inserted through an opening in a rear, and sealed thereto using easy-to-apply methods.

There appear to many known methods and devices to strengthen and improve curb inlets for sewers and drains, such as the following U.S. Pat. Nos.: Des. 31,239 Des. 229,185 Des. 373,181 1,473,551 2,473,279 3,788,756 4,061,434 4,192,625 4,610,566 4,637,585 4,844,403 4,957,268

However, none of these patents discloses or teaches a device for strengthening a curb containing an exit for a roof pipe drain to allow water to pass through the curb.

U.S. Pat. No. 3,957,383 to Fredericks shows a solid curb protector, however, there are no openings therein, and no disclosure of any way of strengthening a curb having an opening for a roof pipe drain therein. Therefore, there exists a need in the art for a device and/or method for forming a strengthened opening through a curb, and for securing a roof drain therein to allow water from a roof to escape through the opening.

SUMMARY OF THE INVENTION

Accordingly, it is a general object of the present invention to provide an improved curb protector. It is a particular object of the present invention to provide an improved curb protector for a roof drainpipe. It is a still more particular object of the present invention to provide an improved device for allowing excess water from a roof to exit through an opening formed in a curb. It is a more particular object of the present invention to provide an improved device for strengthening an opening in a curb through which drain water from a roof is directed. And, it is yet a further particular object of the present invention to provide an improved method of forming a roof drain opening in a curb.

These and other objects of the present invention are achieved by providing a device which is inserted and held in a curb to which a drainpipe from a roof is attached. The device includes a top plate, a front plate and an opening formed through the front, together with means for securing the device in a curb. The present invention also provides a novel method for connecting a roof drain to a device forming an opening through a curb, which device strengthens the opening to prevent undue breakage of the curb, and to provide an aesthetically pleasing appearance.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a description of an improved curb drain protector 10 (FIG. 1), or 12 (FIG. 2) and methods for insertion into a curb 11.

Figure 1:
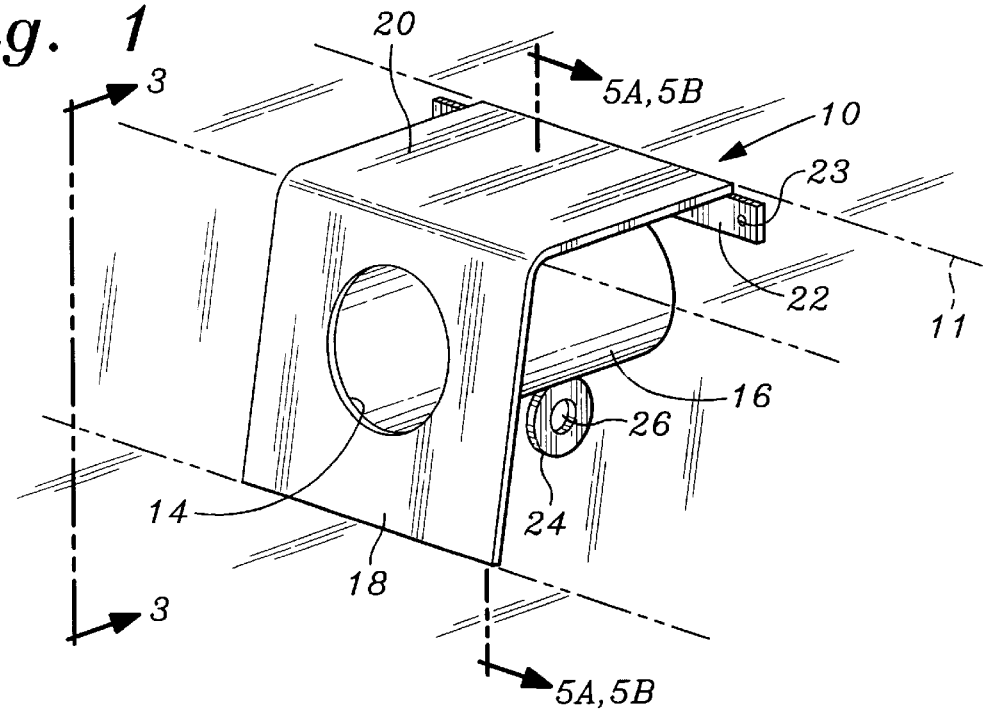
FIG. 1 is an isometric view showing a first embodiment of an improved curb protector of the present invention held in a curb.

Referring now to FIG. 1 of the drawings, there shown is curb drain protector 10, secured in curb 11, shown in broken line. The curb protector 10 has a circular opening 14 formed in a front face or plate 18. The circular opening 14 is connected to a hollow cylindrical element, member or pipe 16, in any desired or known manner. The front face 18 is formed integrally with or firmly secured to a top plate or face 20. For example, although the curb drain protectors 10 and 12 may be made of any available or desirable material, they are preferably made from a high strength material, such as a durable metal or plastic. In a preferred embodiment of the invention, the curb drain protectors 10 and 12 are made from a heavy gauge steel having a galvanized steel coating to resist rust.

Turning again to FIG. 1, the top plate 20 has a securing or nailing element or flange 22 secured thereto. The securing flange or nailing element 22 may include a pair of apertures 23, passing through opposite ends thereof. The hollow, cylindrical member 16 includes a circular rebar-holding element 24, having a central aperture 26, fixed to a lower portion of the member 16. The top plate 20 and front face are preferably formed from a single piece of material, with the front face formed at an angle of more than 90° with respect to the top plate, to match the angle of any curb in which it will be secured. The remaining elements, such as the hollow, cylindrical element 16, securing element 22 and rebar-holding element 24 are preferably permanently secured, as by welding to the adjoining elements.

Figure 2:
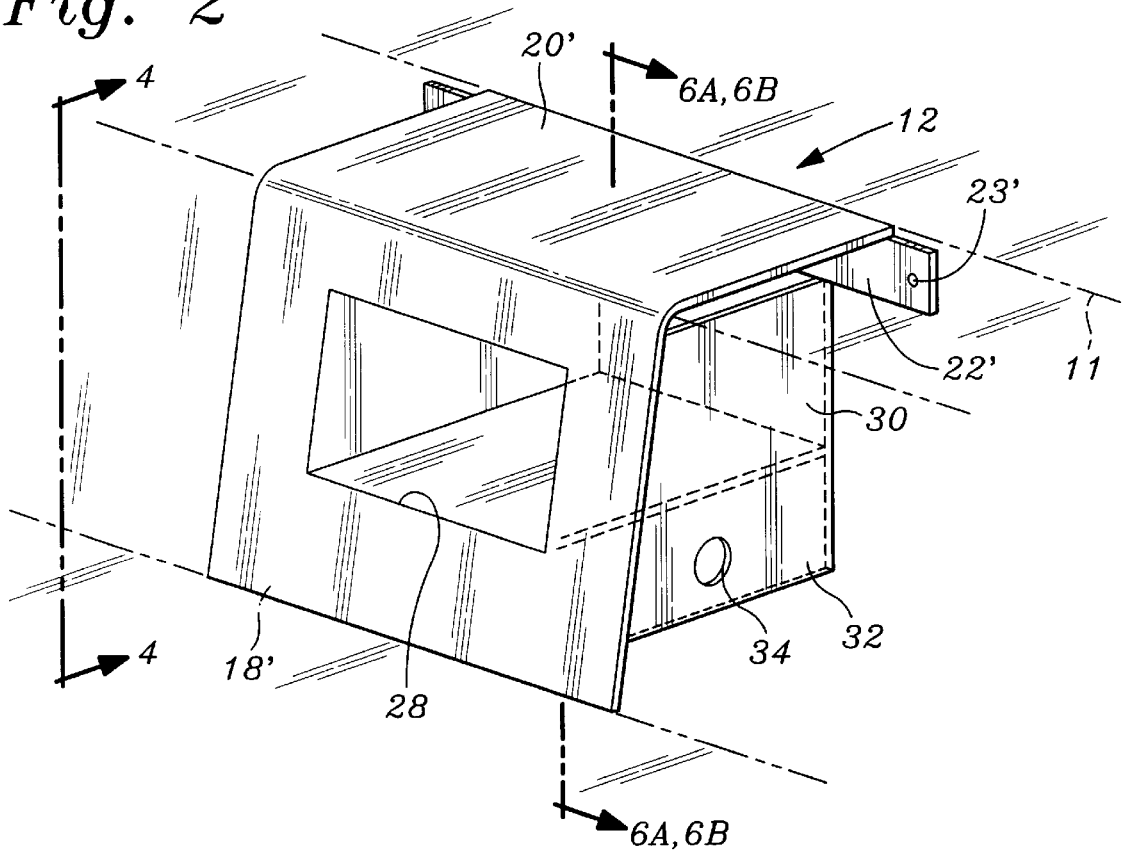
FIG. 2 is an isometric view of a second embodiment of an improved curb protector of the present invention held in a curb.

Turning now to FIG. 2, there shown is a second embodiment of the curb protector 12, inserted and held in the curb 11. This curb protector 12 has a rectangular opening or exit 28 formed in a front face or plate 18'. The front face or plate 18' is, in turn, secured to or formed integrally with a top face or plate 20', having a form securing element 22' fixed thereto at a rear edge. The securing element 22' has a pair of apertures 23' at or near opposite ends thereof. A hollow, rectangular member or pipe 30 is secured, as by welding, to the opening 28 to allow rectangular drainpipes from roof drains to be secured thereto, for exit of drain water through the opening 28. The hollow, rectangular member 30 includes a pair of extending plate portions 32 secured, as by welding, on a lower surface thereof. These extending portions 32 having aligned rebar-holding apertures 34 formed therein.

Figure 3:
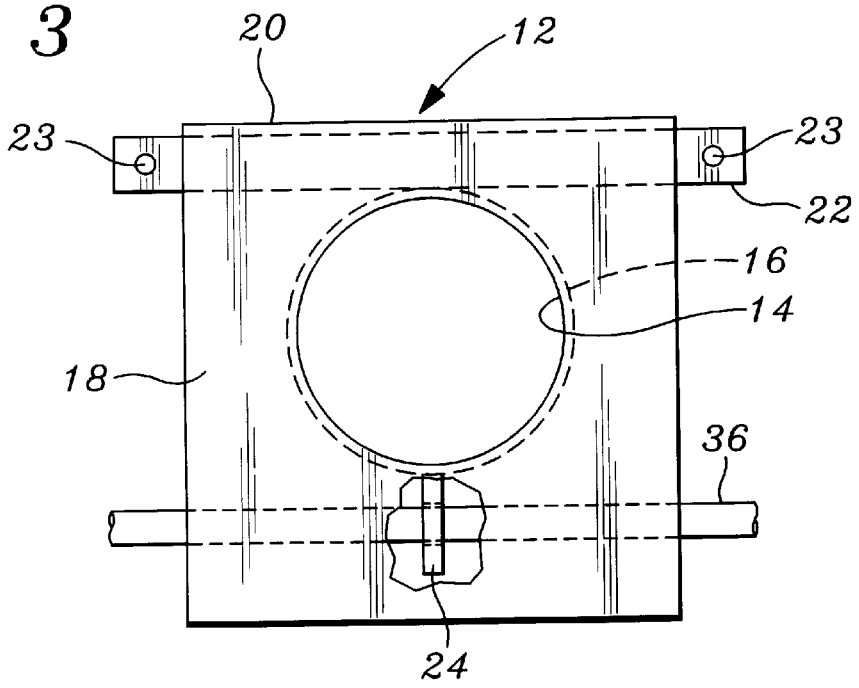
FIG. 3 is a front elevational view of the curb protector of FIG. 1.
Figure 4:
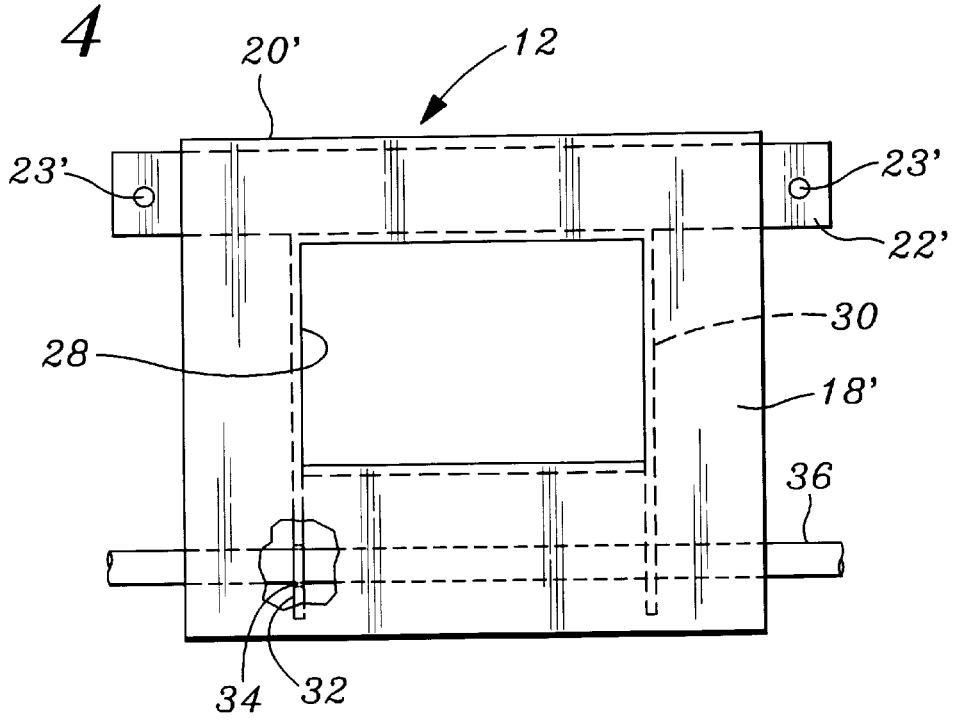
FIG. 4 is a front elevational view of the curb protector of FIG. 2.

As best shown in FIGS. 3 and 4, a length of rebar 36 is passed through the aperture 26 or pair of aligned apertures 34 to more securely hold the curb drain protectors 10 and 12 in curb 11. In preferred installations of the protectors 10 and 12, the rebar used is #4, and is of a length so that it extends at least 6 inches past the outer edges of the front and top plates 18, 18' and 20, 20'.

Figure 5A:
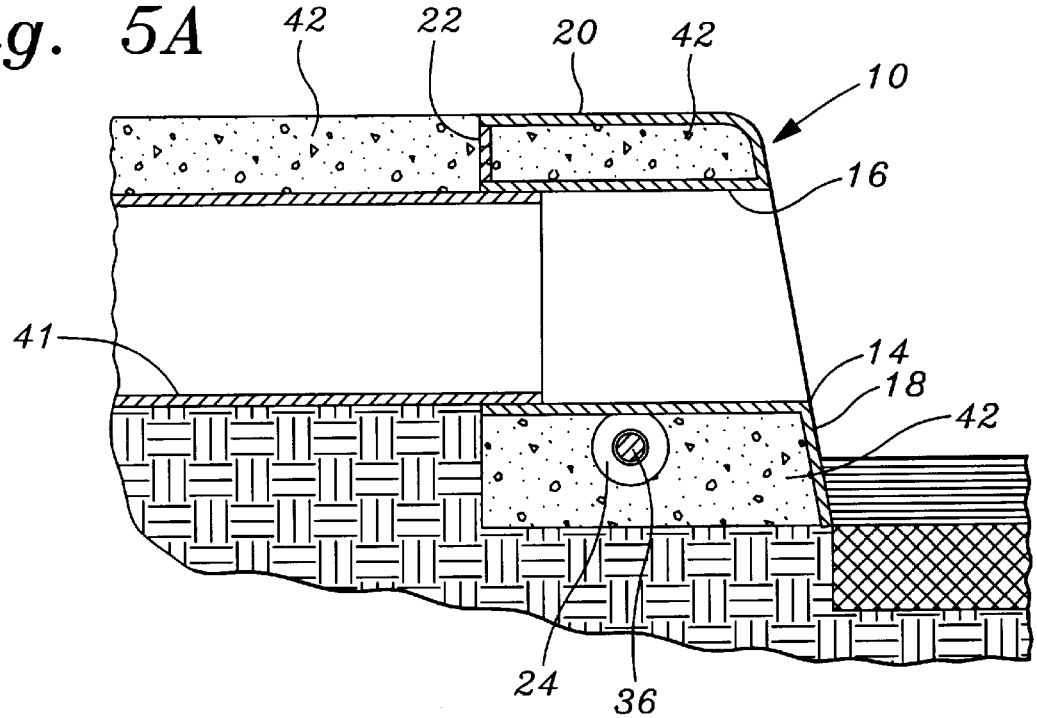
FIGS. 5A and 5B are cross-sectional views taken along lines 5A, 5B—5A, 5B of FIG. 1, showing alternate methods of the present invention, for securing the curb drain protector of FIG. 1 in a curb.
Figure 5B:
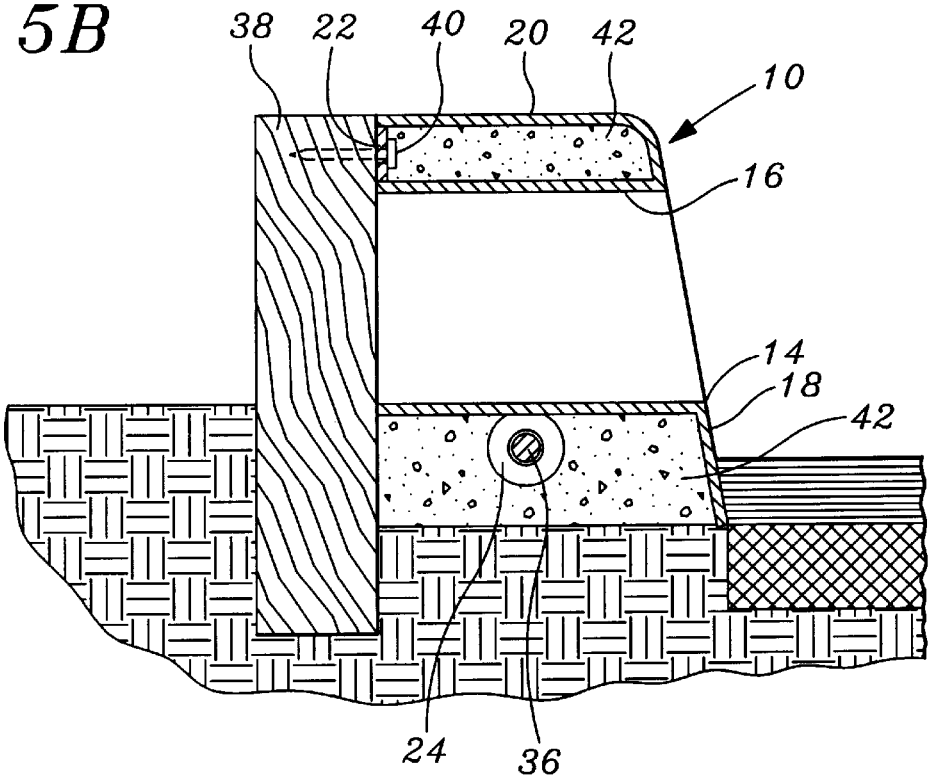
Figure 6A:
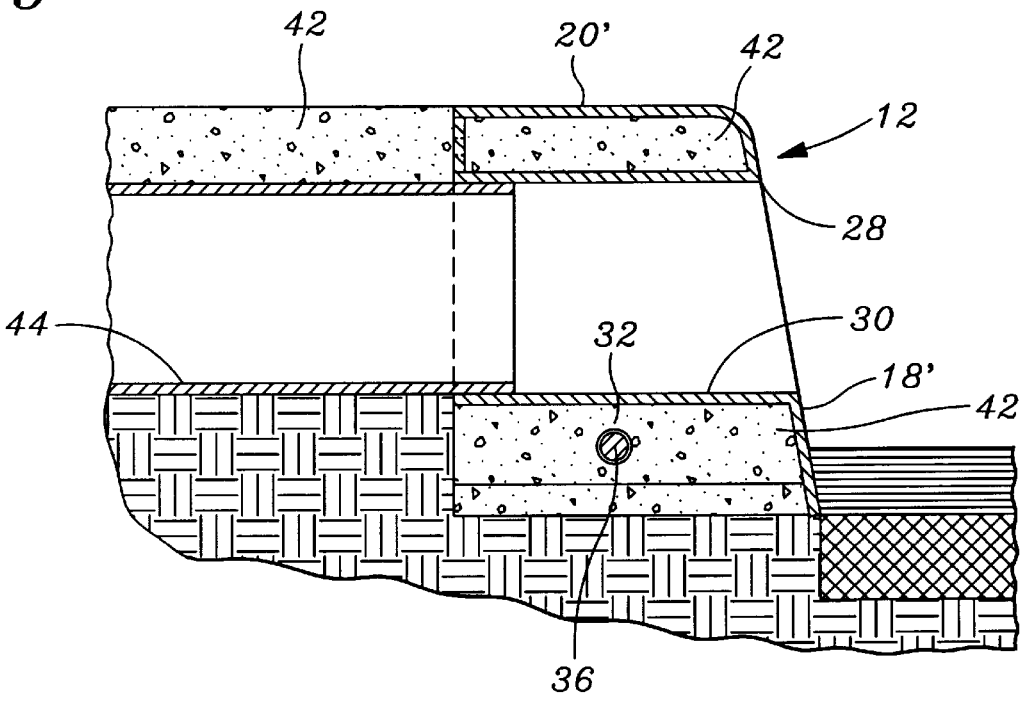
FIGS. 6A and 6B are cross-sectional views taken along lines 6A, 6B—6A, 6B of FIG. 2, showing alternate methods of securing the curb drain protector of FIG. 2 in a curb.
Figure 6B:
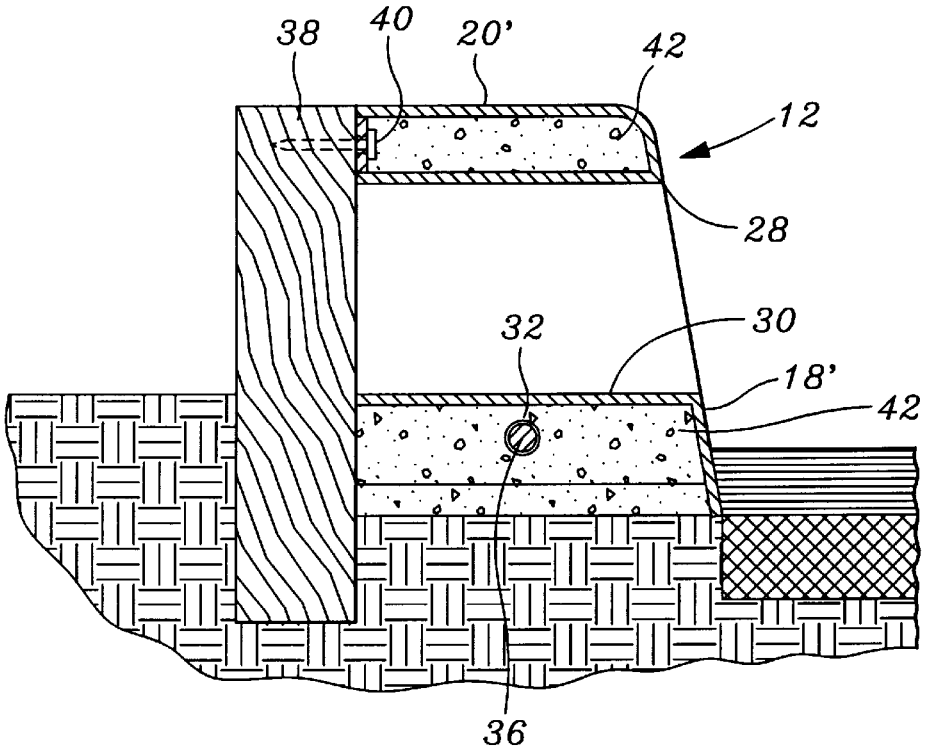

FIGS. 5A, 5B, 6A and 6B illustrate two of the various methods or means for securing the curb drain protectors 10, 12 of the present invention in the curb 11. As best shown in FIGS. 5B and 6B, the curb drain protectors 10, 12 are first secured in place in a form 38, such as one made from wood, and well known to those skilled in the art. The top plate 20, 20' is placed flush with the top of the form 38 to provide a self-leveling effect. Securing elements 40, such as nails, screws, or the like, are then passed through apertures 23, 23' at the ends of the securing elements 22, 22', to more securely hold the curb drain protectors in place, aligned with and against the form 38. Rebar 36 is placed through the aperture 26 in protector 10, or aligned apertures 34 in protector 12. Concrete 42 is then poured into form 38, and allowed to set, to form curb 11. After the concrete sets, the form 38 is removed, and a cylindrical drainpipe 41 secured, as by bonding to cylindrical element 16, or a rectangular drainpipe 44 secured to rectangular element 30. Thus, there is formed an aesthetically pleasing, strong curb drain opening that will stand up to wear and tear for an extended period of time.

As best shown in FIGS. 5A and 6A, after the form 38 is entirely removed, the curb drain protector 10, 12 in the curb 11 are directly abutted against a sidewalk portion of concrete 42 in which the drainpipe 41 or 44, as described above, is secured to or attached to the protector. With the rebar 36 in apertures 24, 32, the set concrete 42 around the drainpipe 41, 42 and protector 10, 12 securely holds the curb drain protector 10, 12 and drainpipe 41, 42.

It is to be understood that the elements of the present invention are sized and dimensioned to fit various size and shape curbs and drainpipes, depending on where they are to be used. For example, the angled front faces would be matched to local code requirements, the top plates would be substantially flat, and the size and configuration of the opening will depend on the drainpipe connection, local rainfall conditions, soil and other factors.

Thus, there have been described an improved device and method for forming strengthen drainpipe exists through sidewalk curbs. The improved devices of the present invention both strengthen and extend the life of curb drain exits, and improve their looks. Furthermore, such improved curb drain protectors may be more accurately inserted using less labor and time, thus saving money on installation and/or repair.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A device for protecting a drain opening passing through a curb, comprising:

a holding element for securing the device in a curb;

a front plate having an opening for attachment to a drainpipe, for carrying water through the opening;

a top plate secured to the front plate for alignment with a top of a curb;

the holding element for securing the device in a curb being secured to the top plate; and at least one opening for holding a portion of rebar to the device.

2. The device of claim 1, further including a hollow element secured to the opening and extending under the top plate.

3. The device of claim 2 wherein the hollow element is secured to the holding element for securing the device in a curb.

4. The device of claim 3 where in the hollow element is substantially cylindrical, and the holding element for securing the device in a curb is an elongated bar secured between the top plate and a top portion of the hollow cylindrical element.

5. The device of claim 4 wherein the at least one opening for holding a portion of rebar is a substantially circular element having an aperture formed therein; the substantially circular element being secured to a lower portion of the hollow cylindrical element.

6. The device of claim 3 wherein the hollow element is substantially rectangular, the at least one opening for holding a portion of rebar is secured to the substantially rectangular hollow element and the opening in the front plate is substantially the same size and shape as the substantially rectangular hollow element.

7. The apparatus of claim 6 wherein the at least one opening for holding a portion of rebar is comprised of a pair of aligned openings formed in a pair of extending plate portions secured to a lower portion of the substantially rectangular hollow element.

8. The device of claim 1 wherein the holding element for securing the device in a curb is an elongated bar; and the elongated bar includes apertures formed therein.

9. The device of claim 8 wherein the elongated bar is secured to a top portion of a hollow, cylindrical element, and the hollow cylindrical element is secured to a circular opening in the face plate.

10. The device of claim 9 wherein the face plate is secured to the top plate so as to form an angle which is greater than 90° between the face plate and the top plate.

11. The device of claim 10 wherein the at least one opening for holding a portion of rebar is a substantially circular element having an aperture formed therein; and the substantially circular element is secured to a lower portion of the substantially circular hollow element.

12. The device of claim 8 wherein the elongated bar is secured between the top plate and a top portion of a hollow rectangular element; and the hollow rectangular element is secured to a rectangular opening in the faceplate.

13. The device of claim 12 wherein the face plate is secured to the top plate so as to form an angle which is greater than 90° between the face plate and the top plate.

14. The device of claim 13 wherein the at least one opening for holding a portion of rebar is a pair of aligned openings formed in extending portions secured to a lower portion of the hollow rectangular element.

15. A device for forming a strengthened drain opening in a curb, comprising:

an angled face plate having an opening therein;

a top plate secured to the angled faceplate;

a hollow element secured to the opening in the angled face plate, and extending under the top plate; and an elongated bar secured between the top plate and the hollow element, at a rear edge of the top plate, away from the angled face plate.

16. The device of claim 15 wherein the hollow element is cylindrical and the opening in the face plate is circular; and wherein a circular element having an aperture therein is secured to a lower portion of the cylindrical hollow element.

17. The device of claim 15 wherein the hollow element is substantially rectangular, and the opening in the angled face plate is substantially rectangular; and wherein a pair of aligned openings are formed in a pair of extending portions secured to lower portions of the substantially rectangular hollow element.

18. The device of claim 1 wherein the elongated bar includes apertures formed at outer ends thereof, and the hollow element includes a rebar-holding portion secured to a lower portion of the hollow element.

19. A method of forming and strengthening a roof drain opening through a curb, comprising the steps of:

providing a curb drain protector for insertion into a curb;

building a form around the curb drain protector;

securing the curb drain protector in the form;

placing a length of rebar through at least one opening formed in a lower portion of the curb drain protector; and pouring concrete in the form and around the curb drain protector to secure the curb drain protector in place.

20. The method of claim 19, including the further steps of passing securing elements through apertures formed at a rear portion of the curb drain protector to firmly secure the curb drain protector to the form before pouring the concrete; and after the concrete has set and the form is removed, securing a roof drainpipe to the curb drain protector.

* * * * *